US011199352B1

(12) United States Patent
DuPlessis

(10) Patent No.: US 11,199,352 B1
(45) Date of Patent: Dec. 14, 2021

(54) COUNTERTOP WATER DISPENSER AND ICE MAKING ASSEMBLY

(71) Applicant: Haier US Appliance Solutions, Inc., Wilmington, DE (US)

(72) Inventor: Samuel Vincent DuPlessis, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 16/931,638

(22) Filed: Jul. 17, 2020

(51) Int. Cl.
*F25C 5/182* (2018.01)
*F25C 1/25* (2018.01)
*B67D 1/00* (2006.01)

(52) U.S. Cl.
CPC ..... *F25C 1/25* (2018.01); *B67D 1/0011* (2013.01); *F25C 5/182* (2013.01); *B67D 2210/0001* (2013.01); *B67D 2210/00031* (2013.01); *F25C 2400/14* (2013.01)

(58) Field of Classification Search
CPC ..... F25C 1/25; F25C 5/182; F25C 2400/14; B67D 1/0011; B67D 2210/0001; F25D 31/002; F25D 2323/121
See application file for complete search history.

(56) References Cited

U.S. PATENT DOCUMENTS 2,963,885 A * 12/1960 Loewenthal ..... F25C 1/12 62/344
4,207,994 A * 6/1980 Offlee, Sr. ..... F25D 23/126 165/63
6,101,835 A * 8/2000 Butsch ..... B67D 1/0864 222/146.1
8,756,950 B2 6/2014 Brunner
2016/0025406 A1* 1/2016 An ..... C02F 1/003 222/143
2018/0128530 A1* 5/2018 Mitchell ..... C02F 1/283

FOREIGN PATENT DOCUMENTS

KR 101746613 B1 6/2017

OTHER PUBLICATIONS

Whynter, Whynter Countertop Direct Connection Ice Maker and Water Dispenser, 4 pages.

* cited by examiner

*Primary Examiner* — Cassey D Bauer
(74) *Attorney, Agent, or Firm* — Dority & Manning, P.A.

(57) ABSTRACT

A countertop appliance, as provided herein, may include a dispenser casing, a water path, a water filter, a dispenser valve, an output storage tank, an internal storage valve, and an ice maker. The dispenser casing may define an interior cavity. The water path may be enclosed within the interior cavity. The water path may define a water inlet and an assembly water outlet. The output storage tank may be disposed along the water path to hold a preset volume of water upstream from the assembly water outlet. The internal storage valve may be disposed along the water path and configured to maintain the preset volume of water within the output storage tank. The ice maker may be downstream from the output storage tank to receive water therefrom.

16 Claims, 4 Drawing Sheets

COUNTERTOP WATER DISPENSER AND ICE MAKING ASSEMBLY

FIELD OF THE INVENTION

The present subject matter relates generally to water dispensers and ice making appliances, and more particularly to stand-alone water dispensers and ice making appliances to be selectively placed on a table or countertop.

BACKGROUND OF THE INVENTION

Ice makers generally produce ice for the use of consumers, such as in drinks being consumed, for cooling foods or drinks to be consumed or for other various purposes. Certain refrigerator appliances include ice makers for producing ice. The ice maker can be positioned within the appliance's freezer chamber and direct ice into an ice bucket where it can be stored within the freezer chamber. Such refrigerator appliances can also include a dispensing system for assisting a user with accessing ice produced by the refrigerator appliance's ice maker. However, the incorporation of ice makers into refrigerator appliances can have drawbacks, such as limits on the amount of ice that can be produced and the reliance on the refrigeration system of the refrigerator appliance to form the ice.

Recently, stand-alone ice makers have been developed. These ice makers are separate from refrigerator appliances and provide independent ice supplies. Generally, ice is provided into an interior volume. However, supplying a steady volume of water can be difficult. This can be especially true in the case of gravity fed or nugget ice makers. Separate from or in addition concerns regarding a steady supply of water, water supplied to an ice maker may often contain aesthetic or health contaminants that may impact the performance (e.g., taste/smell of ice produced) or life of the ice maker.

It some contexts, it may be useful to provide a water dispenser nearby or adjacent to an ice maker. Nonetheless, existing appliances have often forced consumers to choose between singular, integrated appliances or completely separate ice makers and water dispensers. Singular, integrated appliances are often cumbersome and difficult to manage. Completely separate ice makers and water dispensers fail to work cooperatively and may, thus, be inefficient.

As a result, it would be useful to provide an assembly capable of separately dispensing water and generating ice. In particular, it may be advantageous to provide a modular or efficient assembly for dispensing water while ensuring a steady supply of water for an ice maker.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a countertop appliance is provided. The countertop appliance may include a dispenser casing, a water path, a water filter, a dispenser valve, an output storage tank, an internal storage valve, and an ice maker. The dispenser casing may define an interior cavity. The water path may be enclosed within the interior cavity. The water path may define a water inlet, a dispenser water outlet, and an assembly water outlet. The water path may further define a first water line extending to the dispenser water outlet and a second water line extending to the assembly water outlet in fluid parallel to the first water line. The water filter may be disposed along the water path to filter water from the water inlet. The dispenser valve may be disposed along the first water line to selectively release water from the water path through the dispenser water outlet. The output storage tank may be disposed along the second water line to hold a preset volume of water upstream from the assembly water outlet. The internal storage valve may be disposed along the second water line downstream from the water filter. The internal storage valve may be configured to maintain the preset volume of water within the output storage tank. The ice maker may be downstream from the output storage tank to receive water therefrom.

In another exemplary aspect of the present disclosure, a countertop appliance is provided. The countertop appliance may include a dispenser casing, a water path, a water filter, a dispenser valve, an output storage tank, an internal storage valve, an ice assembly, and an ice maker. The dispenser casing may define an interior cavity. The water path may be enclosed within the interior cavity. The water path may define a water inlet, a dispenser water outlet, and an assembly water outlet. The water path may further define a first water line extending to the dispenser water outlet and a second water line extending to the assembly water outlet in fluid parallel to the first water line. The water filter may be disposed along the water path to filter water from the water inlet. The dispenser valve may be disposed along the first water line to selectively release water from the water path through the dispenser water outlet. The output storage tank may be disposed along the second water line to hold a preset volume of water upstream from the assembly water outlet. The internal storage valve may be disposed along the second water line downstream from the water filter. The internal storage valve may be configured to maintain the preset volume of water within the output storage tank. The ice assembly casing may be movably connected to the output storage tank, the ice assembly casing defining an internal cavity outside of the interior cavity of the dispenser. The ice maker may be mounted within the internal cavity downstream from the output storage tank to receive water therefrom.

In yet another exemplary aspect of the present disclosure, a countertop appliance is provided. The countertop appliance may include a dispenser casing, a water path, a water filter, a dispenser valve, an output storage tank, an internal storage valve, an ice assembly, and an ice maker. The dispenser casing may define an interior cavity. The water path may be enclosed within the interior cavity. The water path may define a water inlet and an assembly water outlet. The output storage tank may be disposed along the water path to hold a preset volume of water upstream from the assembly water outlet. The internal storage valve may be disposed along the water path. The internal storage valve may be configured to maintain the preset volume of water within the output storage tank. The ice assembly casing may be movably connected to the output storage tank. The ice assembly casing may define an internal cavity outside of the interior cavity of the dispenser. The ice maker may be mounted within the internal cavity downstream from the output storage tank to receive water therefrom.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
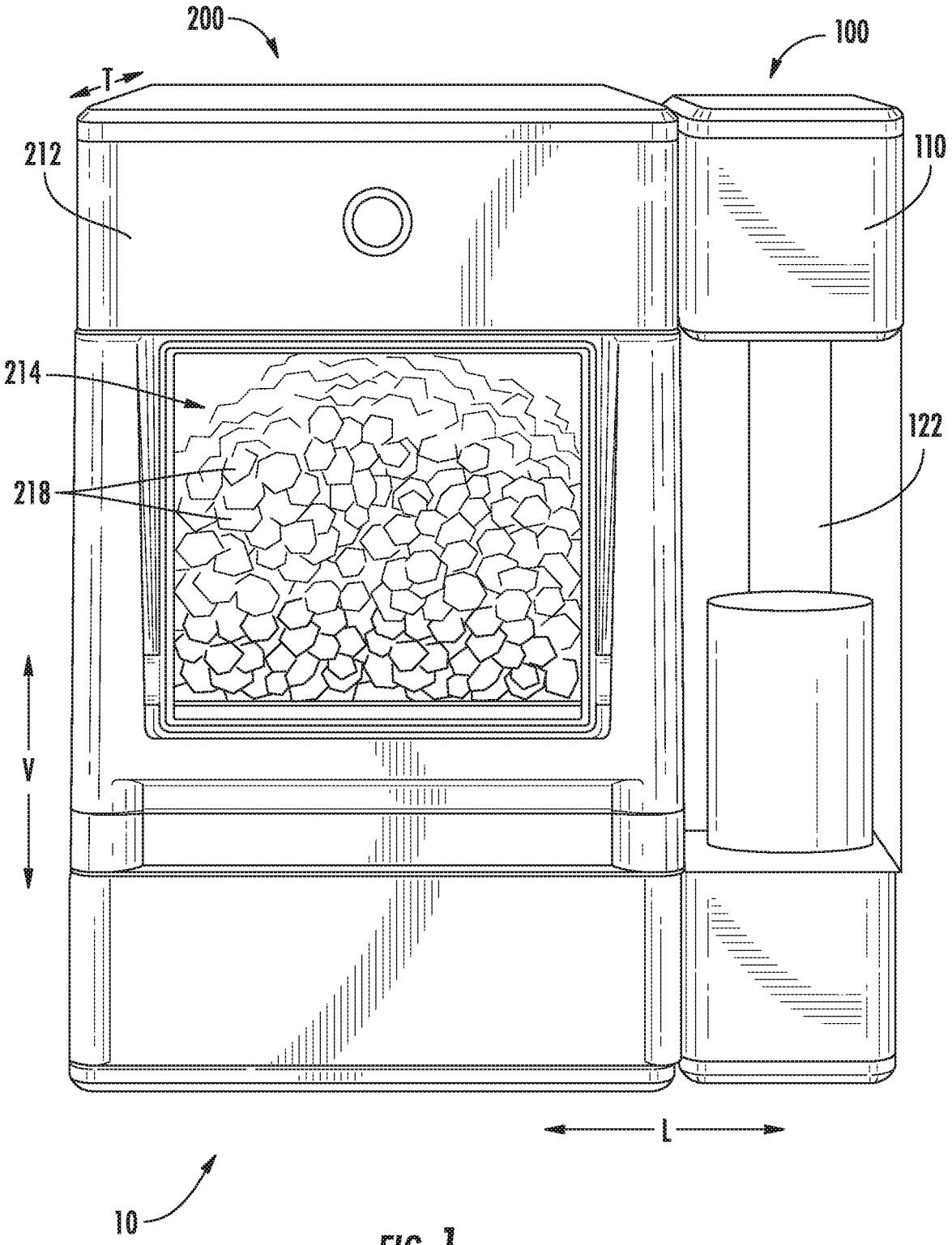
FIG. 1 provides a perspective view of a countertop appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Turning now to the figures, FIG. 1 provides a perspective view of a countertop appliance 10 according to exemplary embodiments of the present disclosure. Countertop appliance 10 may include a discrete water dispenser 100 and an ice making assembly 200, as will be described in greater detail below. Optionally, water dispenser 100 and ice making assembly 200 may be provided as discrete modular components that may be selectively decoupled or disconnected and moved relative to each other. In some such embodiments, water dispenser 100 includes a dispenser casing 110 while ice making assembly 200 includes an ice assembly casing 212 (e.g., separate or independent of dispenser casing 110).

Countertop appliance 10 is generally sized and shaped to be supported on a conventional residential or commercial countertop (e.g., such that a user may place appliance 10 on, and move appliance 10 along, the countertop). Nonetheless, it is understood that appliance 10 is provided as an exemplary embodiment and the present disclosure not limited to any particular size or shape, except as otherwise provided herein.

As shown, appliance 10 (or a portion thereof) generally defines a defines a vertical direction V, a lateral direction L, and a transverse direction T. The vertical direction V, lateral direction L, and transverse direction T are all mutually perpendicular and form an orthogonal direction system. Optionally, the vertical direction V, lateral direction L, and transverse direction T may be defined at dispenser casing 110 or ice assembly casing 212.

Figure 2:
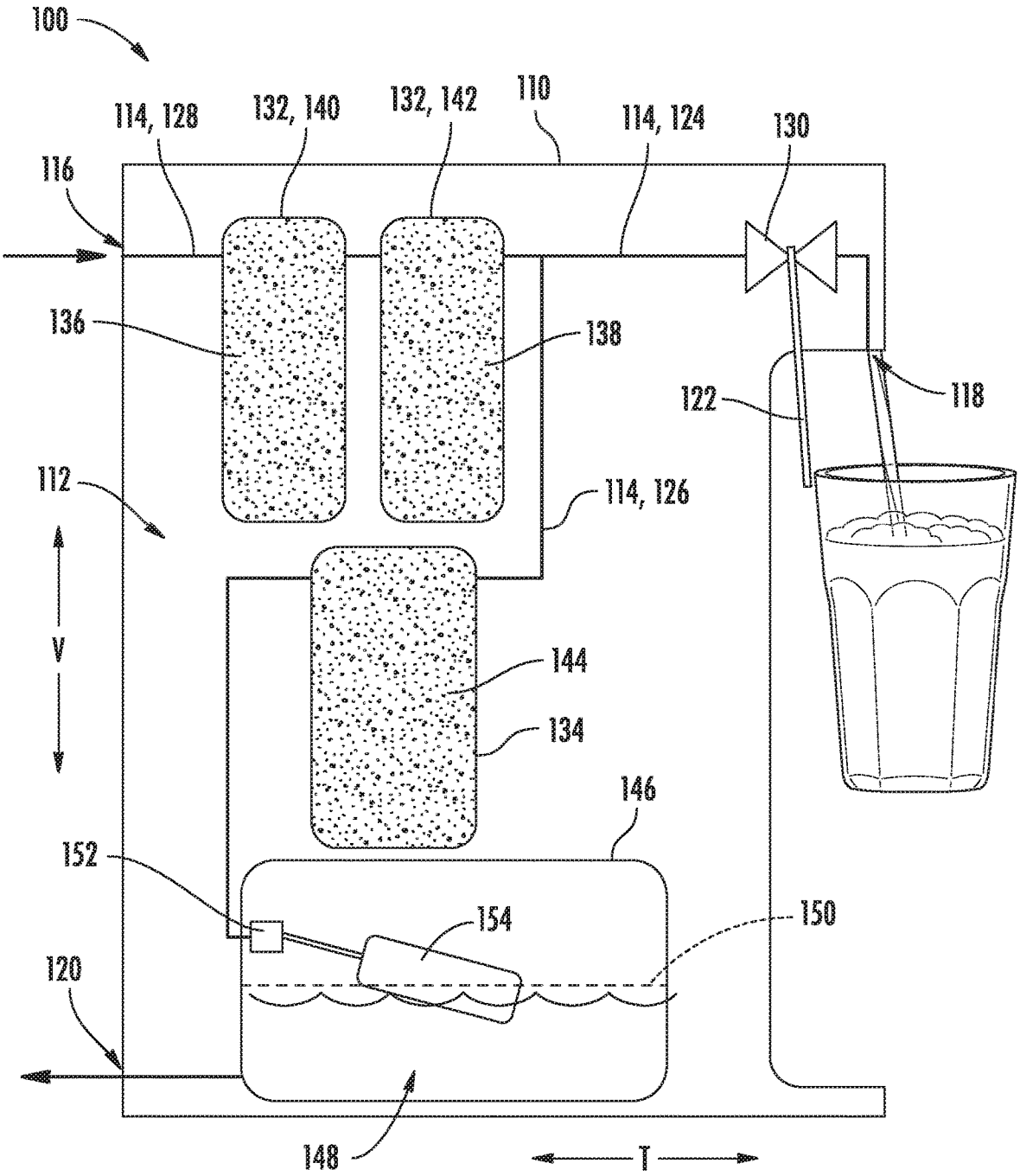
FIG. 2 provides a schematic, sectional, elevation view of the water dispenser of the exemplary countertop appliance of FIG. 1.

Turning now to FIGS. 1 and 2, FIG. 2 provides a schematic, sectional, elevation view of the water dispenser 100. As shown, dispenser casing 110 defines an interior cavity 112. Interior cavity 112 at least partially houses various other components of the water dispenser 100 therein. In particular, a water path 114 is enclosed within interior cavity 112. In other words, one or more continuously joined pipes or conduits forming a water path 114 for guiding water are enclosed within interior cavity 112. Water path 114 can be selectively connected (e.g., fluidly connected via a conduit or hose) to a suitable water source, such as a municipal or residential water supply. As will be described in greater detail below, water path 114 generally provides or defines a water inlet 116 that extends to a discrete dispenser water outlet 118 and assembly water outlet 120. Thus, water from the water source may be received at the water inlet 116 before being selectively directed to the dispenser water outlet 118 or the assembly water outlet 120.

Outside of interior cavity 112, dispenser casing 110 may define an open dispenser recess (e.g., beneath or below dispenser water outlet 118). In some embodiments, an actuating mechanism 122, shown as a paddle, is mounted below dispenser water outlet 118 to selectively release or dispense water from dispenser water outlet 118. In alternative embodiments, any suitable actuating mechanism may be used to release or dispense water. For example, actuating mechanism 122 can include a sensor (such as an ultrasonic sensor) or a button rather than the paddle.

As shown in FIG. 2, water path 114 may include or define a discrete first water line 124 and second water line 126. First and second water lines 124, 126 are generally provided in fluid parallel to each other and may be formed, for instance, as separate downstream branches extending from a common introductory line 128. In other words, first and second water lines 124, 126 may be separate lines splitting from introductory line 128 (e.g., at a connection joint), which itself extends from water inlet 116. When assembled, first water line 124 extends to dispenser water outlet 118. For instance, first water line 124 may extend from the connection joint of introductory line 128 to dispenser water outlet 118. Thus, at least a portion (e.g., first portion) of the water from water inlet 116 may flow through first water line 124 to dispenser water outlet 118. In fluid parallel to first water line 124, second water line 126 extends to assembly water outlet 120. For instance, second water line 126 may extend from the connection joint of introductory line 128 to assembly water outlet 120. Thus, at least a portion (e.g., second portion) of the water from water inlet 116 may flow through second water line 126 to assembly water outlet 120. Optionally, dispenser water outlet 118 may be disposed above assembly water outlet 120. Thus, second water line 126 may extend below and terminate at a lower point on dispenser casing 110 than first water line 124.

As noted above, water flowing through first water line 124 may be directed to dispenser water outlet 118. In some embodiments, a dispenser valve 130 is disposed along first water line 124 to control the flow of water through first water line 124. Specifically, dispenser valve 130 may be selectively moved (e.g., opened and closed) to release water from the water path 114 through the dispenser water outlet 118.

Thus, when the dispenser valve 130 is shut, water may be prevented from exiting water dispenser 100 through dispenser water outlet 118. By contrast, when the dispenser valve 130 is opened, water may be permitted to flow from water dispenser 100 through dispenser water outlet 118. Generally, dispenser valve 130 may be operably coupled to actuating mechanism 122. For instance, dispenser valve 130 may be mechanically connected or joined to actuating mechanism 122 such that dispenser valve 130 moves (e.g., opens and closes) according to actuation or positioning of actuating mechanism 122 (e.g., when depressed by a user or container, as would be understood). Dispenser valve 130 may be provided as any suitable fluid valve (e.g., flapper valve, gate valve, ball valve, etc.) to alternate between closed and opened (partially or fully opened) positions.

Along the water path 114 within interior cavity 112, water dispenser 100 may include one or more water filters (e.g., a first water filter 132 or second water filter 134) to filter or treat water flowing from water inlet 116 to dispenser water outlet 118 or assembly water outlet 120.

As an example, a water filter (e.g., first water filter 132) may be disposed along introductory line 128 upstream from both the first and second water lines 124, 126. Thus, water flowing to first water line 124 and second water line 126 may be filtered through first water filter 132 before reaching the water lines 124, 126. Generally, any suitable filtration media may be provided within first water filter 132. First water filter 132 may, for instance, include an aesthetic filtration medium 136 (e.g., relatively coarse filtration sediment, activated carbon, or pleated cartridges) or health filtration medium 138 (e.g., relatively fine filtration cellulose, activated carbon, or pleated cartridges). In some embodiments, first water filter 132 is a multi-stage filter including multiple sequential stages, such as a first stage 140 and a second stage 142 downstream from the first stage 140. Different or discrete filtration media may be held within each stage. For instance, separate filter cartridges may be provided for each stage. Thus, first stage 140 may include one filtration medium (e.g., aesthetic filtration medium 136) while second stage 142 includes another filtration medium (e.g., health filtration medium 138).

In some embodiments, aesthetic filtration medium 136 is configured to remove aesthetic impurities such as chlorine, chloramines, iron, manganese, hydrogen sulfide, or zinc, such as filtration elements certified under the NSF/ANSI Standard 42 (as established at of the date of this application). In additional or alternative embodiments, health filtration medium 138 is configured to remove unhealthful contaminants such as heavy metals (e.g., arsenic, cadmium, chromium, copper, lead, mercury, or selenium), inorganics (e.g., fluoride or nitrate plus nitrite), or volatile organic chemicals (e.g., chloroform surrogate or individual organic chemicals), such as filtration elements certified under the NSF/ANSI Standard 53 (as established at the date of this application).

As an additional or alternative example, a water filter (e.g., second water filter 134) may be disposed along second water line 126 upstream from the assembly water outlet 120. Thus, water flowing through second water line 126 may be filtered through second water filter 134 (e.g., after being filtered through first water filter 132). In some embodiments, second water filter 134 includes deionization filtration media 144. For instance, second water filter 134 may include an anion resin and cation resin contained within a container or cartridge. Optionally, deionization filtration media 144 may include a mixed-bed media of commingled anion and cation resin. The mixed-bed media may be configured to remove dissolved solids, such as inorganic salts of sodium and chlorine ions, from the water flowing through second water line 126.

In some embodiments, an output storage tank 146 is provided along second water line 126. As shown, output storage tank 146 generally provides an enlarged region (e.g., relative to the rest of second water line 126) within which water may be held upstream from assembly water outlet 120. For instance, a preset volume of water 148 may be collected or held within output storage tank 146. The preset volume of water 148 may be delineated at a predetermined height or water level 150 within output storage tank 146. In certain embodiments, output storage tank 146 is disposed downstream of the one or more water filters (e.g., first water filter 132 or second water filter 134). Thus, water collected within output storage tank 146 may be prefiltered (i.e., already filtered through water filter(s) 132, 134 of water dispenser 100).

Advantageously, appliance 10 may provide for selective filtration of water to be consumed directly by a user or water to ice making assembly 200. Such filtered water may notably improve the performance or life of ice making assembly 200 (e.g., without requiring cumbersome or expensive integration of filtration or dispensing components within ice making assembly 200).

Along with output storage tank 146, an internal storage valve 152 may be disposed along second water line 126. For instance, internal storage valve 152 may be disposed downstream of the first water filter 132 or the second water filter 134. In some embodiments, internal storage valve 152 is further disposed upstream of output storage tank 146. As shown, output storage tank 146 may be mounted below the dispenser valve 130, advantageously accumulating water therein under the motivation of gravity.

Generally, internal storage valve 152 may be configured to control the flow of water through at least a portion of second water line 126. Specifically, internal storage valve 152 may be selectively moved (e.g., opened and closed) to release water to output storage tank 146. For instance, internal storage valve 152 may open and close to maintain the preset volume of water 148 within output storage tank 146. During use, detection of a volume of water less than the preset water volume 148 (e.g., below the predetermined height or water level 150) may prompt internal storage valve 152 to open, permitting water through second water line 126 to output storage tank 146. Contrarily, detection of a volume of water greater than or equal to the preset water volume 148 (e.g., at or above the predetermined height or water level 150) may prompt internal storage valve 152 to close, preventing further water flow to output storage tank 146. Optionally, internal storage valve 152 may be a fluidly controlled valve (e.g., not controlled or motivated by an electrical signal thereto). For instance, internal storage valve 152 may include a floater valve 154 having a ballast within (or in fluid communication with) the volume of output storage tank 146. In some such embodiments, the floater valve 154 is set to close (i.e., move to a closed position preventing water flow therethrough) at the predetermined water height 150 corresponding to the preset volume of water 148 within output storage tank 146. Thus, the floater valve 154 may only open (i.e., move to an opened position permitting water flow therethrough) when water within the output storage tank 146 falls below the predetermined water height 150; closing again when water within the output storage tank 146 again reaches the predetermined water height 150.

Figure 3:
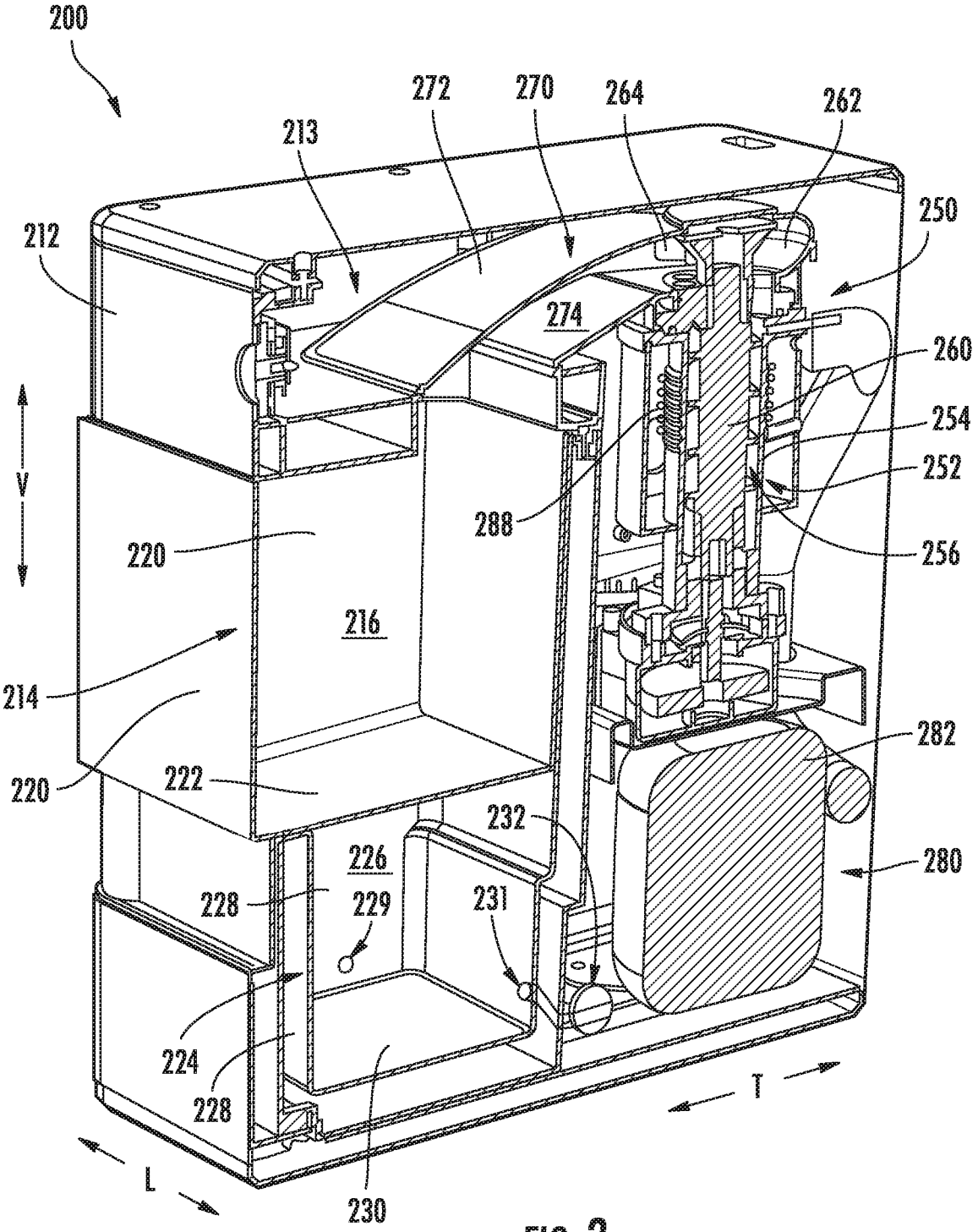
FIG. 3 provides a sectional perspective view of the ice making assembly of FIG. 1.
Figure 4:
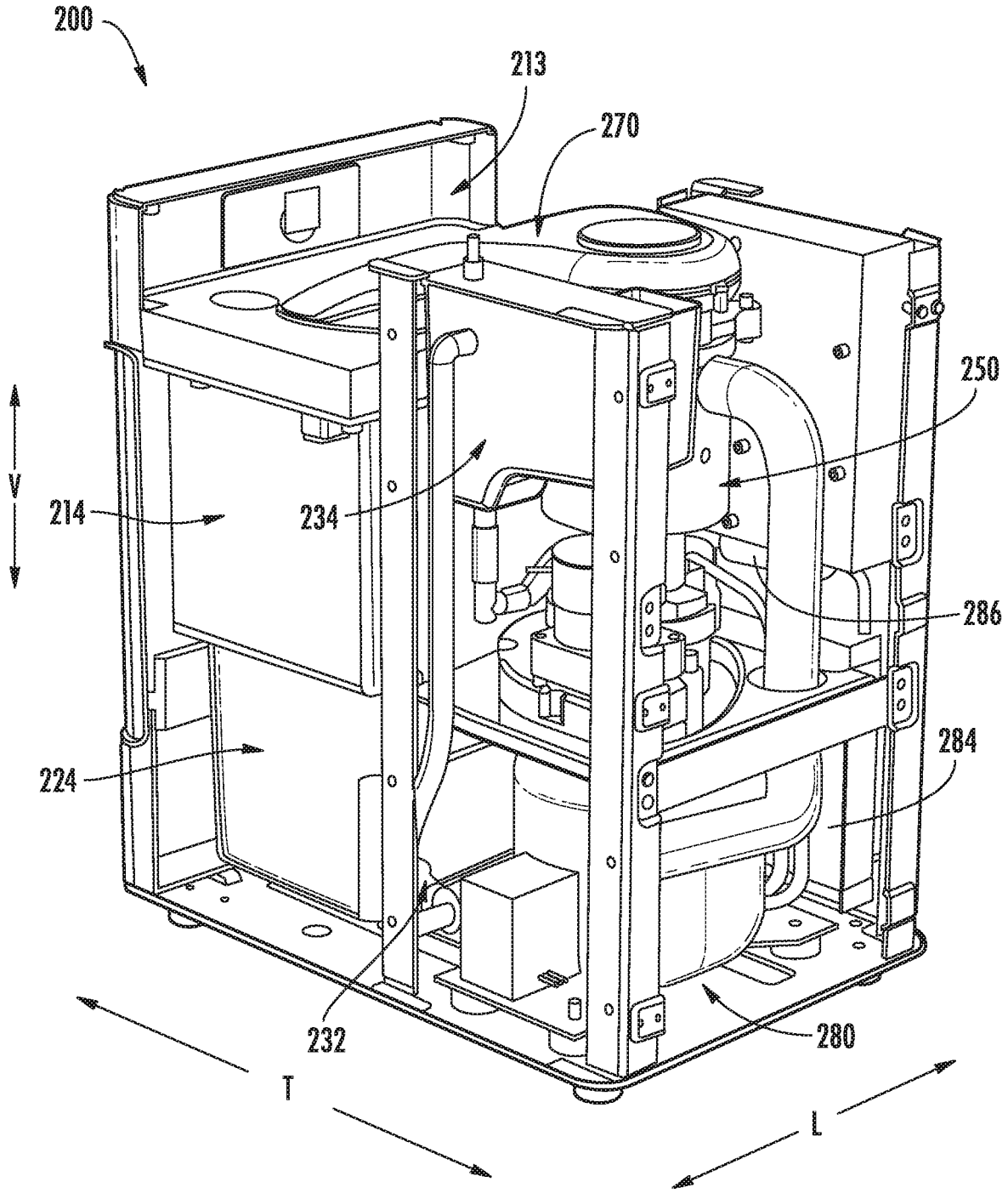
FIG. 4 provides a rear perspective view of the water dispenser of the exemplary countertop appliance of FIG. 1, wherein a portion of a casing has been removed for clarity.

Turning now generally to FIG. 1, as well as FIGS. 3 and 4, FIGS. 3 and 4 provide various views of ice making assembly 200, wherein various portions have been removed for clarity. Generally, ice making assembly 200 provides an ice maker 250 downstream of assembly water outlet 120. When assembled, ice maker 250 may thus receive a steady supply water (e.g., directly or indirectly) from output storage tank 146. In some such embodiments, assembly water outlet 120 (FIG. 2) connects to a water tank 224 within ice making assembly 200 (e.g., at an inlet opening 229 via an intermediate conduit that extends between the casings 110 and 212).

As shown, assembly 200 includes an outer casing 212 that defines an internal volume 213 and generally at least partially houses various other components of the assembly 200 therein.

A container 214 of assembly 200 is also illustrated. Container 214 defines a first storage volume 216 for the receipt and storage of ice 218 therein. A user of the assembly 200 may access ice 218 within the container 214 for consumption or other uses. Container 214 may include one or more sidewalls 220 and a base wall 222, which may together define the first storage volume 216. In exemplary embodiments, at least one sidewall 220 may be formed from a clear, see-through (i.e., transparent or translucent) material, such as a clear glass or plastic, such that a user can see into the first storage volume 216 and thus view ice 218 therein. Further, in exemplary embodiments, container 214 may be removable, such as from the outer casing 212, by a user. This facilitates easy access by the user to ice within the container 214 and further, for example, may provide access to a water tank 224 of the assembly 200.

Generally, water tank 224 defines a second storage volume 226 for the receipt and holding of water. Water tank 224 may include one or more sidewalls 228 and a base wall 230 which may together define the second storage volume 226. In exemplary embodiments, the water tank 224 may be disposed below the container 214 along a vertical direction V defined for the assembly 200, as shown.

As discussed, in exemplary embodiments, water is provided to the water tank 224 for use in forming ice. For instance, water may be suppled into water tank 224. For instance, an inlet opening 229 may be defined through water tank 224 downstream from output storage tank 146 (FIG. 2) (e.g., via assembly water outlet 120 and the intermediate conduit extending between the casings 110 and 212). Water may thus steadily fill or be maintained within water tank 224 from output storage tank 146.

Assembly 200 may further include a pump 232. Pump 232 may be in fluid communication with the second storage volume 226. For example, water may be flowable from the second storage volume 226 through an opening 231 defined in the water tank 224, such as in a sidewall 228 thereof, and may flow through a conduit to and through pump 232. Pump 232 may, when activated, actively flow water from the second storage volume 226 therethrough and from the pump 232.

Water actively flowed from the pump 232 may be flowed (e.g., through a suitable conduit) to a reservoir 234. For example, reservoir 234 may define a third storage volume 236, which may be defined by one or more sidewalls 238 and a base wall 240. Third storage volume 236 may, for example, be in fluid communication with the pump 232 and may thus receive water that is actively flowed from the water tank 224, such as through the pump 232. For example, water may be flowed into the third storage volume 236 through an opening 242 defined in the reservoir 234.

Reservoir 234 and third storage volume 236 thereof may receive and contain water to be provided to an ice maker 250 for the production of ice. Accordingly, third storage volume 236 may be in fluid communication with ice maker 250. For example, water may be flowed, such as through opening 244 and through suitable conduits, from third storage volume 236 to ice maker 250.

Ice maker 250 generally receives water, such as from reservoir 234, and freezes the water to form ice 218. In exemplary embodiments, ice maker 250 is a nugget ice maker, and in particular is an auger-style ice maker, although other suitable styles of ice makers are within the scope and spirit of the present disclosure. As shown, ice maker 250 may include a casing 252 into which water from third storage volume 236 is flowed. Casing 252 is thus in fluid communication with third storage volume 236. For example, casing 252 may include one or more sidewalls 254 which may define an interior volume 256, and an opening 258 may be defined in a sidewall 254. Water may be flowed from third storage volume 236 through the opening 258 (such as via a suitable conduit) into the interior volume 256.

As illustrated, an auger 260 may be disposed at least partially within the casing 252. During operation, the auger 260 may rotate. Water within the casing 252 may at least partially freeze due to heat exchange, such as with a refrigeration system as discussed herein. The at least partially frozen water may be lifted by the auger 260 from casing 252. Further, in exemplary embodiments, the at least partially frozen water may be directed by auger 260 to and through an extruder 262. The extruder 262 may extrude the at least partially frozen water to form ice, such as nuggets of ice 218.

Formed ice 218 may be provided by the ice maker 250 to container 214 and may be received in the first storage volume 216 thereof. For example, ice 218 formed by auger 260 or extruder 262 may be provide to the container 214. In exemplary embodiments, assembly 200 may include a chute 270 for directing ice 218 produced by the ice maker 250 towards the first storage volume 216. For example, as shown, chute 270 is generally positioned above container 214 along the vertical direction V. Thus, ice can slide off of chute 270 and drop into storage volume 216 of container 214. Chute 270 may, as shown, extend between ice maker 250 and container 214, and may include a body 272 which defines a passage 274 therethrough. Ice 218 may be directed from the ice maker 250 (such as from the auger 260 or extruder 262) through the passage 274 to the container 214. In some embodiments, for example, a sweep 264, which may for example be connected to and rotate with the auger 260, may contact the ice emerging through the extruder 262 from the auger 260 and direct the ice 218 through the passage 274 to the container 214.

As discussed, water within the casing 252 may at least partially freeze due to heat exchange, such as with a refrigeration system. In exemplary embodiments, ice maker 250 may include a sealed refrigeration system 280. The sealed refrigeration system 280 may be in thermal communication with the casing 252 to remove heat from the casing 252 and interior volume 256 thereof, thus facilitating freezing of water therein to form ice. Sealed refrigeration system 280 may, for example, include a compressor 282, a condenser 284, a throttling device 286, and an evaporator 288. Evaporator 288 may, for example, be in thermal communication with the casing 252 in order to remove heat from the interior volume 256 and water therein during operation of sealed system 280. For example, evaporator 288 may at least partially surround the casing 252. In particular, evaporator 288 may be a conduit coiled around and in contact with casing 252, such as the sidewall(s) 254 thereof.

During operation of sealed system 280, refrigerant exits evaporator 288 as a fluid in the form of a superheated vapor or vapor mixture. Upon exiting evaporator 288, the refrigerant enters compressor 282 wherein the pressure and temperature of the refrigerant are increased such that the refrigerant becomes a superheated vapor. The superheated vapor from compressor 282 enters condenser 284 wherein energy is transferred therefrom and condenses into a saturated liquid or liquid vapor mixture. This fluid exits condenser 284 and travels through throttling device 286 that is configured for regulating a flow rate of refrigerant therethrough. Upon exiting throttling device 286, the pressure and temperature of the refrigerant drop at which time the refrigerant enters evaporator 288 and the cycle repeats itself. In certain exemplary embodiments, throttling device 286 may be a capillary tube. Notably, in some embodiments, sealed system 280 may additionally include fans (not shown) for facilitating heat transfer to/from the condenser 284 and evaporator 288.

As discussed, in exemplary embodiments, ice 218 may be nugget ice. Nugget ice is ice that that is maintained or stored (i.e., in first storage volume 216 of container 214) at a temperature greater than the melting point of water or greater than about thirty-two degrees Fahrenheit. Accordingly, the ambient temperature of the environment surrounding the container 214 may be at a temperature greater than the melting point of water or greater than about thirty-two degrees Fahrenheit. In some embodiments, such temperature may be greater than forty degrees Fahrenheit, greater than fifty degrees Fahrenheit, or greater than sixty degrees Fahrenheit.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A countertop appliance assembly comprising:
a dispenser casing defining an interior cavity;
a water path enclosed within the interior cavity, the water path defining a water inlet, a dispenser water outlet, and an assembly water outlet, the water path further defining a first water line extending to the dispenser water outlet and a second water line extending to the assembly water outlet in fluid parallel to the first water line;
a water filter disposed along the water path to filter water from the water inlet;
a dispenser valve disposed along the first water line to selectively release water from the water path through the dispenser water outlet;
an output storage tank disposed along the second water line to hold a preset volume of water upstream from the assembly water outlet;
an internal storage valve disposed along the second water line downstream from the water filter, the internal storage valve being configured to maintain the preset volume of water within the output storage tank; and
an ice maker downstream from the output storage tank to receive water therefrom,
wherein the dispenser water outlet is disposed above the assembly water outlet, and
wherein the output storage tank is disposed below the dispenser water valve to accumulate water within the output storage tank as motivated by gravity.

2. The countertop appliance of claim 1, wherein the water filter is disposed upstream from the first and second water lines.

3. The countertop appliance of claim 1, wherein the water filter is disposed along the second water line.

4. The countertop appliance of claim 3, wherein the water filter comprises deionization filtration media.

5. The countertop appliance of claim 1, wherein the water filter is a first water filter disposed upstream from the first and second water lines, and wherein the countertop appliance further comprises:
a second water filter disposed along the second water line.

6. The countertop appliance of claim 1, wherein the internal storage valve comprises a floater valve set to close at a predetermined water height corresponding to the preset volume of water within the output storage tank.

7. The countertop appliance of claim 1, further comprising:
an ice assembly casing defining an internal cavity outside of the interior cavity of the dispenser casing, wherein the ice maker is mounted within the internal cavity of the ice assembly casing.

8. The countertop appliance of claim 7, further comprising a water tank mounted within the internal cavity of the ice assembly casing in fluid communication between the output storage tank and the ice maker.

9. A countertop appliance assembly comprising:
a dispenser casing defining an interior cavity;
a water path enclosed within the interior cavity, the water path defining a water inlet and an assembly water outlet;
an output storage tank disposed along the water path to hold a preset volume of water upstream from the assembly water outlet;
an internal storage valve disposed along the water path, the internal storage valve being configured to maintain the preset volume of water within the output storage tank;
an ice assembly casing movably connected to the output storage tank, the ice assembly casing defining an internal cavity outside of the interior cavity of the dispenser casing; and
an ice maker mounted within the internal cavity downstream from the output storage tank to receive water therefrom;
wherein the dispenser water outlet is disposed above the assembly water outlet, and
wherein the output storage tank and the assembly water outlet are disposed below the assembly water inlet to accumulate water within the output storage tank and permit the release of water from the assembly water outlet as motivated by gravity.

10. A countertop appliance assembly comprising:
a dispenser casing defining an interior cavity;
a water path enclosed within the interior cavity, the water path defining a water inlet, a dispenser water outlet, and an assembly water outlet, the water path further defining a first water line extending to the dispenser water outlet and a second water line extending to the assembly water outlet in fluid parallel to the first water line;
a water filter disposed along the water path to filter water from the water inlet;

a dispenser valve disposed along the first water line to selectively release water from the water path through the dispenser water outlet;

an output storage tank disposed along the second water line to hold a preset volume of water upstream from the assembly water outlet;

an internal storage valve disposed along the second water line downstream from the water filter, the internal storage valve being configured to maintain the preset volume of water within the output storage tank;

an ice assembly casing movably connected to the output storage tank, the ice assembly casing defining an internal cavity outside of the interior cavity of the dispenser casing; and an ice maker mounted within the internal cavity downstream from the output storage tank to receive water therefrom, wherein the dispenser water outlet is disposed above the assembly water outlet, and wherein the output storage tank is disposed below the dispenser water valve to accumulate water within the output storage tank as motivated by gravity.

11. The countertop appliance of claim 10, wherein the water filter is disposed upstream from the first and second water lines.

12. The countertop appliance of claim 10, wherein the water filter is disposed along the second water line.

13. The countertop appliance of claim 12, wherein the water filter comprises deionization filtration media.

14. The countertop appliance of claim 10, wherein the water filter is a first water filter disposed upstream from the first and second water lines, and wherein the countertop appliance further comprises:

a second water filter disposed along the second water line.

15. The countertop appliance of claim 10, wherein the internal storage valve comprises a floater valve set to close at a predetermined water height corresponding to the preset volume of water within the output storage tank.

16. The countertop appliance of claim 10, further comprising a water tank mounted within the internal cavity of the ice assembly casing in fluid communication between the output storage tank and the ice maker.

* * * * *